US012495913B2

(12) United States Patent
Zhu

(10) Patent No.: US 12,495,913 B2
(45) Date of Patent: Dec. 16, 2025

(54) HIGH CHAIR FOR CHILDREN

(71) Applicant: Feng Zhu, Taizhou (CN)

(72) Inventor: Feng Zhu, Taizhou (CN)

( * ) Notice: Subject to any disclaimer, the term of this patent is extended or adjusted under 35 U.S.C. 154(b) by 4 days.

(21) Appl. No.: 19/221,391

(22) Filed: May 28, 2025

(65) Prior Publication Data

US 2025/0288124 A1 Sep. 18, 2025

(30) Foreign Application Priority Data

Apr. 29, 2025 (CN) ..... 202520848445.9

(51) Int. Cl.
*A47D 1/00* (2006.01)
*A47D 1/02* (2006.01)

(52) U.S. Cl.
CPC ..... *A47D 1/006* (2013.01); *A47D 1/0085* (2017.05); *A47D 1/023* (2017.05)

(58) Field of Classification Search
CPC ..... A47D 1/006; A47D 1/023; A47D 1/02; A47D 13/043
See application file for complete search history.

(56) References Cited

U.S. PATENT DOCUMENTS 2,665,742 A * 1/1954 Starysky ..... A47D 13/043 297/137
4,364,576 A * 12/1982 Kassai ..... A47D 13/043 280/87.051
5,056,776 A * 10/1991 Cheng ..... A47D 13/043 280/87.051
5,356,196 A * 10/1994 Chuang ..... A47D 13/043 482/68
5,362,123 A * 11/1994 Simmons ..... A47D 1/02 297/14
5,382,033 A * 1/1995 Cheu ..... A47D 13/043 280/87.051
5,522,782 A * 6/1996 Kurtin ..... A47D 13/04 280/87.051
5,813,720 A * 9/1998 Huang ..... A47D 13/043 280/87.051
6,001,047 A * 12/1999 Ferrara ..... A47D 13/043 280/87.051
6,012,731 A * 1/2000 Liu ..... A47D 13/043 280/87.051
6,247,750 B1 * 6/2001 Tsai ..... A47C 4/286 297/16.2
6,386,563 B1 * 5/2002 Chen ..... A47D 13/043 280/87.051

(Continued)

FOREIGN PATENT DOCUMENTS

CN 111000403 A * 4/2020 ..... A47D 15/00
CN 119138732 A * 12/2024 ..... E06C 1/005
WO WO-2024243477 A1 * 11/2024 ..... A47D 3/00

*Primary Examiner* — Timothy J Brindley
(74) *Attorney, Agent, or Firm* — Daniel M. Cohn; Howard M. Cohn

(57) ABSTRACT

The present disclosure relates to a high chair for children, comprising a high chair body and a number of chair legs installed at the lower end of the high chair body, wherein the high chair body comprises a support ring and a seat unit, the seat unit is made of flexible material and is provided with an accommodating cavity for children to sit, and the upper edge of the seat unit is connected to the support ring.

8 Claims, 7 Drawing Sheets

(56) References Cited

U.S. PATENT DOCUMENTS

| | | | | |
|---|---|---|---|---|
| 7,717,504 | B2 * | 5/2010 | Centracco | A47D 1/106 297/219.12 |
| 10,004,341 | B2 * | 6/2018 | Waldman | A47D 1/02 |
| 10,407,089 | B1 * | 9/2019 | Matranga | A47D 13/043 |
| 10,531,747 | B1 * | 1/2020 | Stravitz | A47D 15/006 |
| 10,736,437 | B2 * | 8/2020 | Goh | A47D 1/02 |
| 10,813,472 | B1 * | 10/2020 | Minemier | A47D 13/043 |
| 11,202,518 | B1 * | 12/2021 | Lo | A47D 1/106 |
| 11,317,735 | B1 * | 5/2022 | Cheng | A47D 1/006 |
| 12,016,469 | B2 * | 6/2024 | Anokhin | A47D 1/006 |
| 12,256,848 | B2 * | 3/2025 | Andersen | A47D 1/006 |
| 2002/0164917 | A1 * | 11/2002 | Keegan | A47D 13/043 297/1 |
| 2023/0371713 | A1 * | 11/2023 | Skilnick | A47D 1/002 |
| 2024/0398133 | A1 * | 12/2024 | He | A47D 1/006 |
| 2025/0049228 | A1 * | 2/2025 | Longenecker | A47D 1/008 |

* cited by examiner

HIGH CHAIR FOR CHILDREN

TECHNICAL FIELD

The present disclosure relates to the field of children's products, in particular to a high chair for children.

BACKGROUND ART

The high chair for children is specially designed for infants or children. Its main function is to limit the range of children's activities so that parents can feed them more easily.

At present, the main bodies of most high chairs for children on the market are made of hard plastic by integrated injection molding process.

SUMMARY OF THE INVENTION

The embodiment of the present disclosure adopts the following technical solution:

A high chair for children comprises a high chair body and a number of chair legs installed at the lower end of the high chair body, wherein the high chair body comprises:

a support ring a seat unit, which is made of flexible material, comprising a seat portion and an upper edge, the seat portion forming a accommodating cavity for a child to sit in, and the upper edge being connected to the support ring; the seat unit being deformable from the seat portion in the direction of the upper edge to enable folding of the seat unit.

Reference signs: 1. High chair body; 2. Chair leg; 21. Support foot; 22. Footrest; 23. Crossbar; 3. Support ring; 31. Connecting part A; 32. Butting part; 33. Plug-in slot; 34. Through hole; 4. Seat unit; 40. Upper Edge; 41. Seat Portion; 42. Connecting part B; 43. Opening; 5. Backrest; 51. Mounting groove; 6. Plate; 61. Clamping strip; 62. Clamping slot A; 63. Clamping slot B.

DETAILED DESCRIPTION OF EMBODIMENTS

Existing high chairs for children have certain shortcomings, for example, the chair body cannot be folded, and large space is occupied during transportation and storage, leading to increased transportation costs and inconvenience during movement. The embodiment of the present disclosure provides a high chair for children, in which a high chair body is divided into a support ring and a seat unit, and the seat unit is made of flexible material, allowing the high chair to be folded by deforming the seat unit, and addressing the issue of inability to fold the existing high chair bodies, which results in excessive space consumption during transportation and storage. The embodiment of the present disclosure is further explained below with reference to the drawings, as shown in FIG. 1 to FIG. 7.

Figure 1:
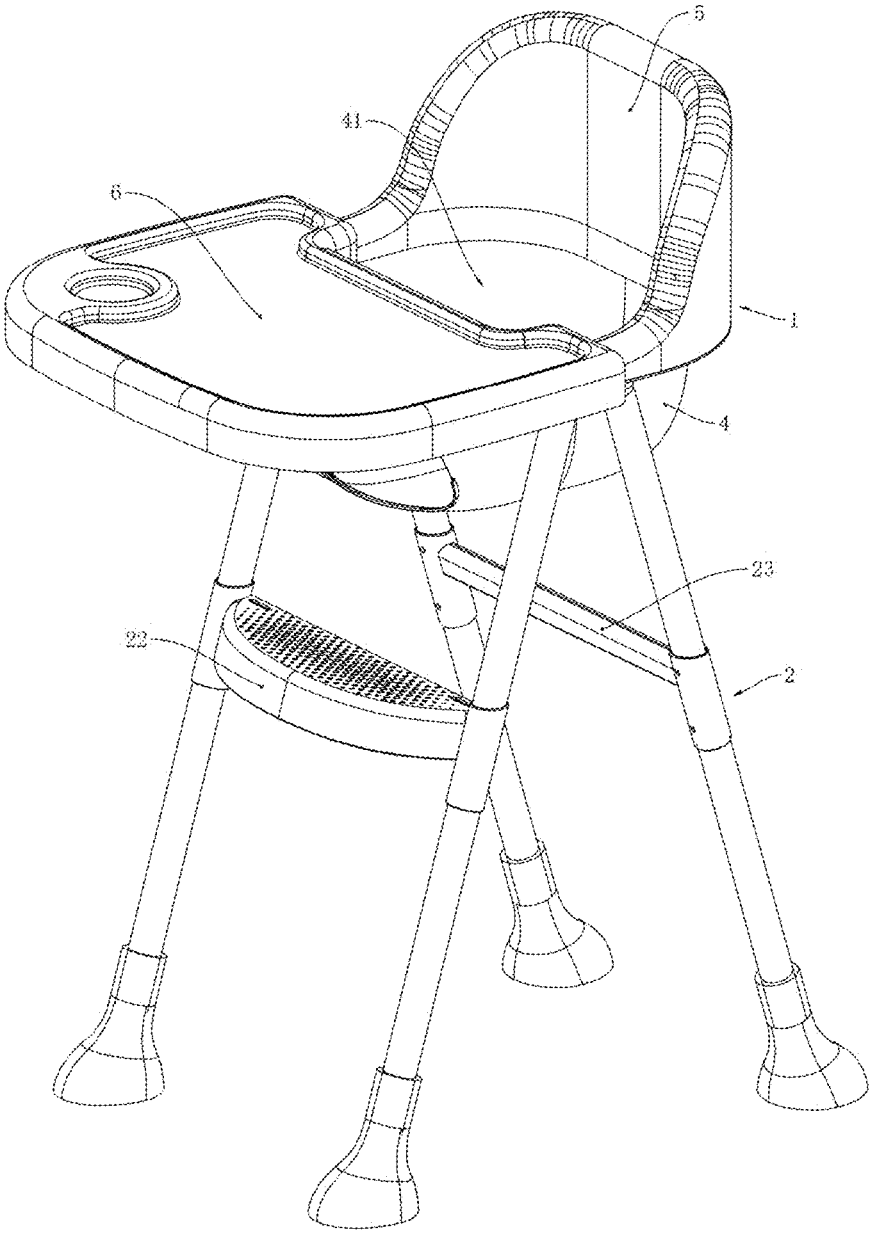
FIG. 1 is the structure diagram 1 for the invention.
Figure 2:
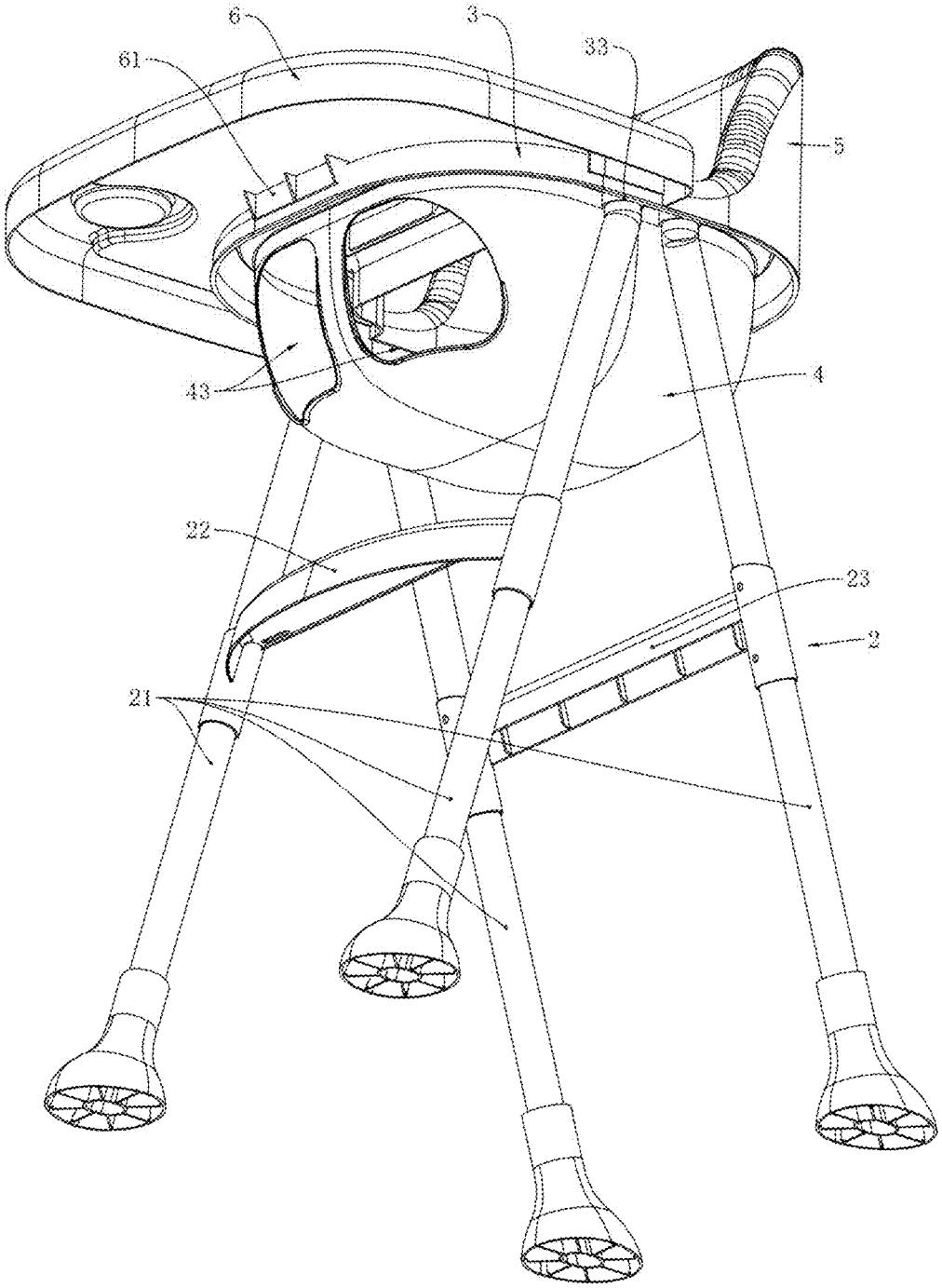
FIG. 2 is the structure diagram 2 for the invention.

As shown in FIG. 1 to FIG. 2, the embodiment of the present disclosure provides a high chair for children, comprising a high chair body 1 and a plurality of chair legs 2 installed at the lower end of the high chair body 1;

As shown in FIG. 1 to FIG. 4, the high chair body 1 comprises a support ring 3, a seat unit 4 and a backrest 5; the backrest 5 is installed at one end of the support ring 3 and is used for children to lean against; the support ring 3 and the backrest 5 are made of hard plastic, which is preferably PP material, but ABS material and PET material can also be selected; the seat unit 4 is made of flexible material, comprising a seat portion 41 and an upper edge 40, the upper edge 40 of the seat unit 4 is connected to the support ring 3, and an seat portion 41 forming a accommodating cavity for a child to sit in, and the lower part of the body of the child can sit into the seat portion 41 of the seat unit 4 by passing through the support ring 3;

Additionally, the seat unit 4 can be deformed by external force, so that the bottom of the seat unit 4 moves towards the direction close to the support ring 3, allowing the seat unit 4 to be folded and then enabling the high chair body 1 to be folded, reducing the occupied space of the high chair body 1 and lowering the transportation cost.

Figure 3:
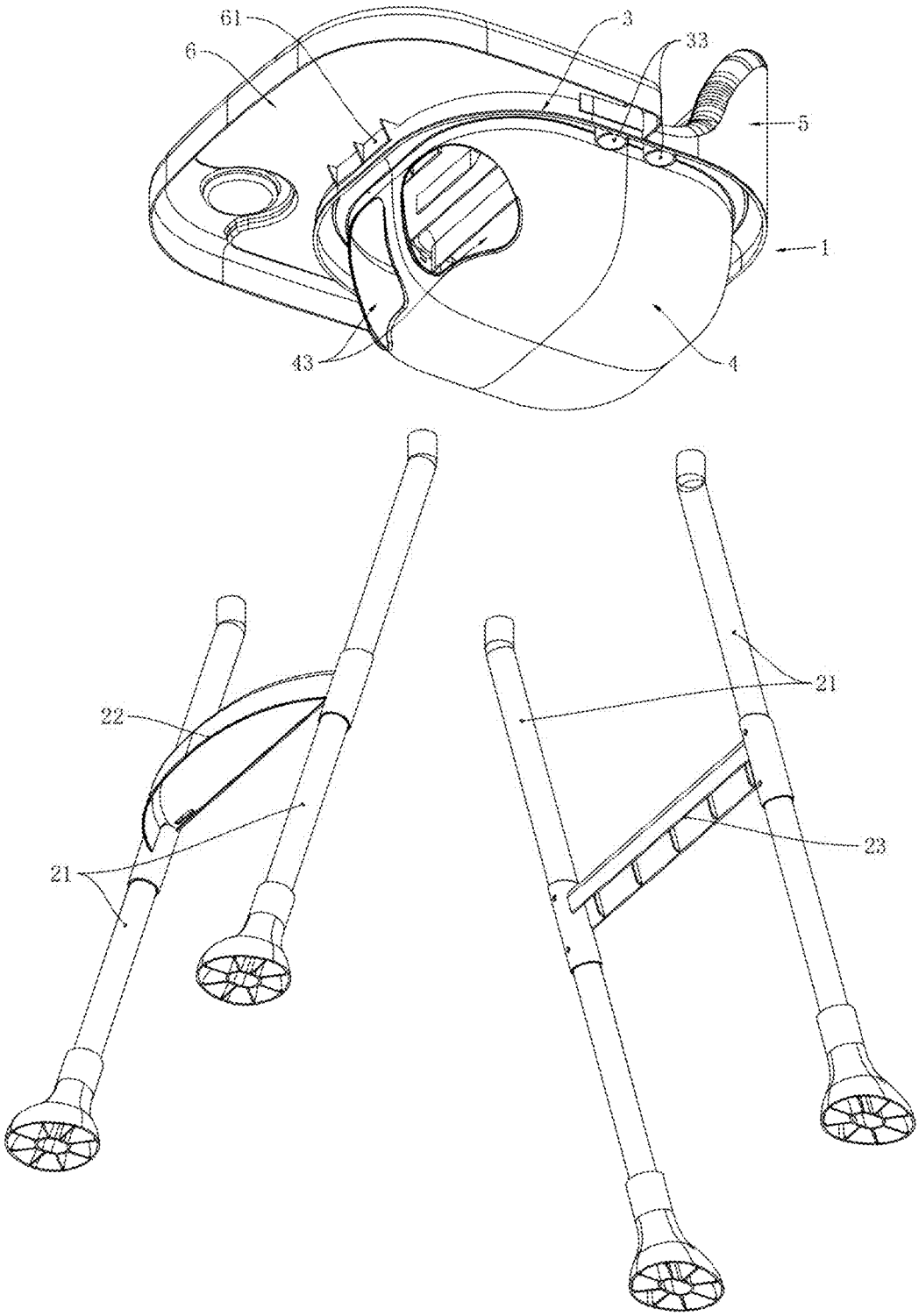
FIG. 3 is the exploded view of the high chair body and the chair legs in the invention.

As shown in FIG. 2 and FIG. 3, the chair legs 2 are detachably installed on the support ring 3 of the high chair body 1. Preferably, the upper end of each support foot 21 of the chair legs 2 is connected in the plug-in slot on the support ring 3 by plug-in or interference fit, block or slot insertion or threaded connection.

In an embodiment, the flexible material is flexible plastic or textile material, wherein the flexible plastic is preferably one of PVC material, silicone material and TPE material (also known as thermoplastic elastomer).

In an embodiment, the textile material is preferably Oxford fabric or cotton fabric.

The support ring 3 and the seat unit 4 are preferably connected by one of integrated injection molding, adhesive connection, detachable connection and hot press molding.

The integrated injection molding of the support ring 3 and the seat pocket 4 is preferably secondary integrated injection molding. That is, the support ring 3 is first made using a mold, and then the support ring 3 is placed into the mold for making the seat unit 4, so that the seat unit 4 is integrally integrated into the support ring 3, that is, the seat unit 4 is formed onto the support ring 3. Specifically, the connecting part A 31 and the connecting part B 42 in the following embodiments are bonded together.

When a detachable connection is adopted between the support ring 3 and the seat unit 4, the backrest 5 in the following embodiment is provided with a mounting groove 51. After the upper end of the support ring 3 and the seat unit 4 is partially or fully inserted into the mounting groove 51, an interference fit is formed between the support ring 3, the seat unit 4, and the mounting groove 51, so that the mounting groove 51 presses and fixes the connecting part B 42 onto the connecting part A 31, thereby achieving the connection between the support ring 3 and the seat unit 4. By applying external force to separate the support ring 3 and the seat unit 4 from the backrest, the connecting part B 42 and the connecting part B A 31 can be detached, enabling disassembly. Alternatively, a button or boss may be provided on the connecting part A 31, and a corresponding connecting hole is formed on the connecting part B 42, so that the connecting part B 42 can be sleeved on the button or boss through the deformation of the connecting hole, thereby achieving a detachable connection.

Figure 4:
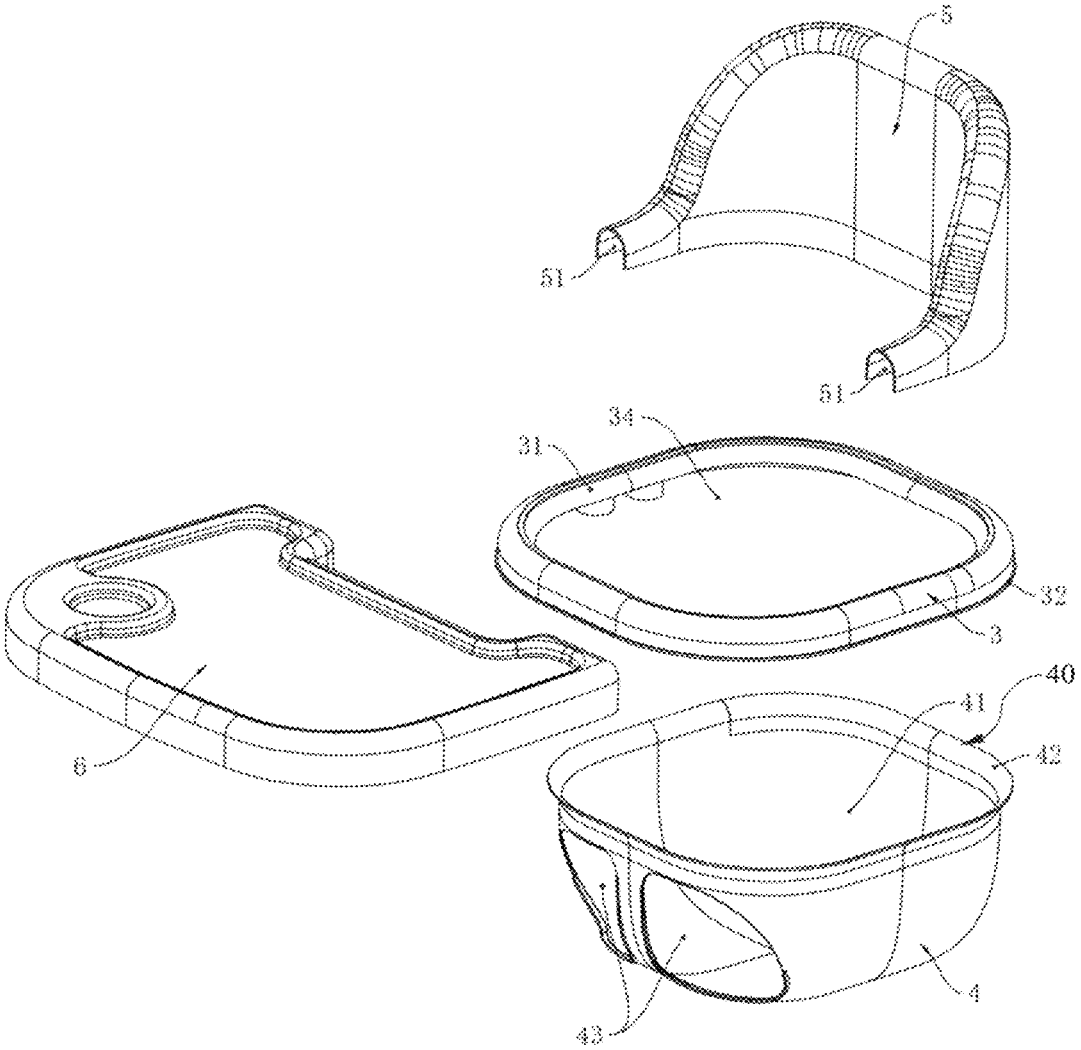
FIG. 4 is the exploded view 1 of the high chair body in the invention.
Figure 5:
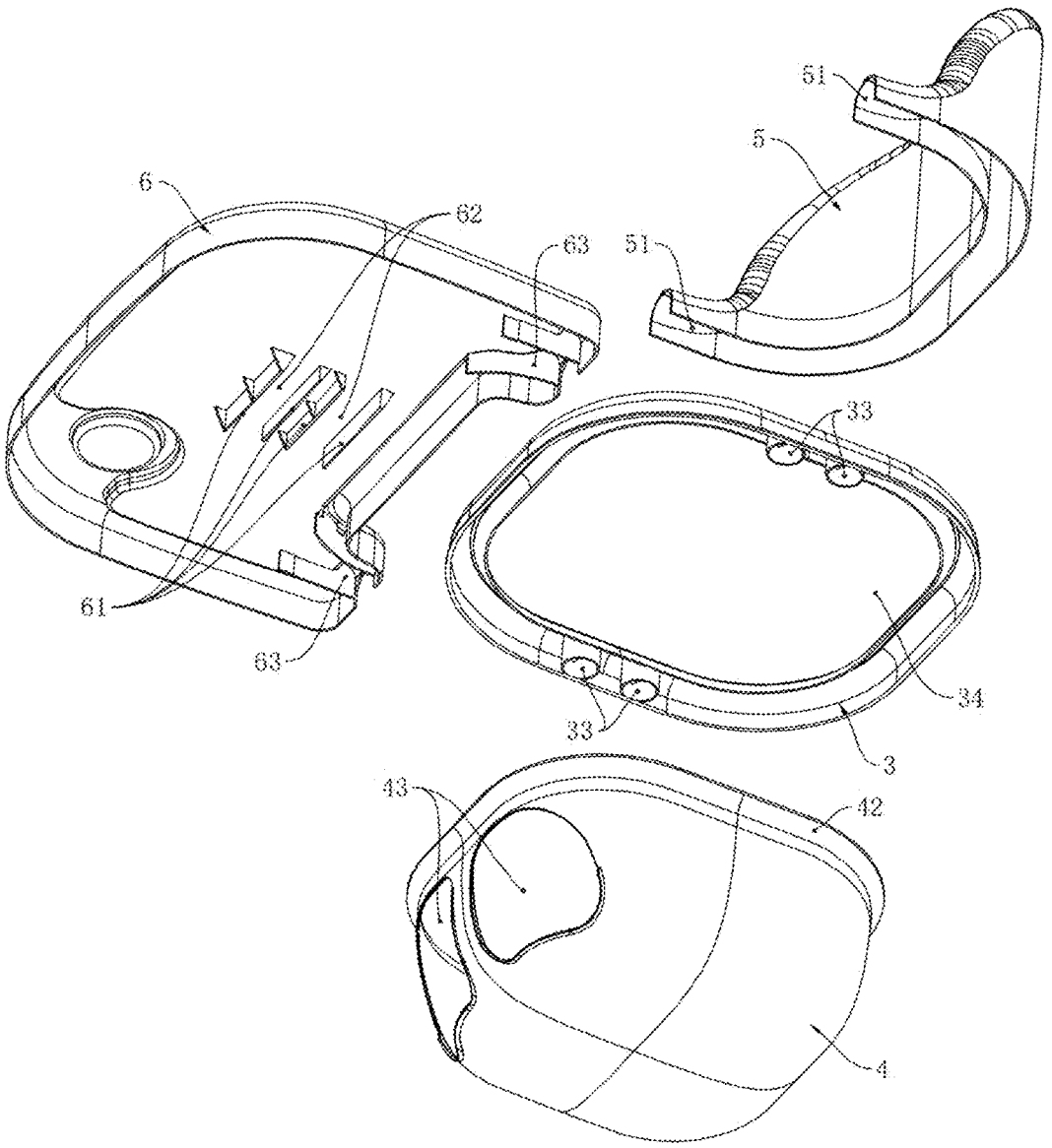
FIG. 5 is the exploded view 2 of the high chair body in the invention.
Figure 6:
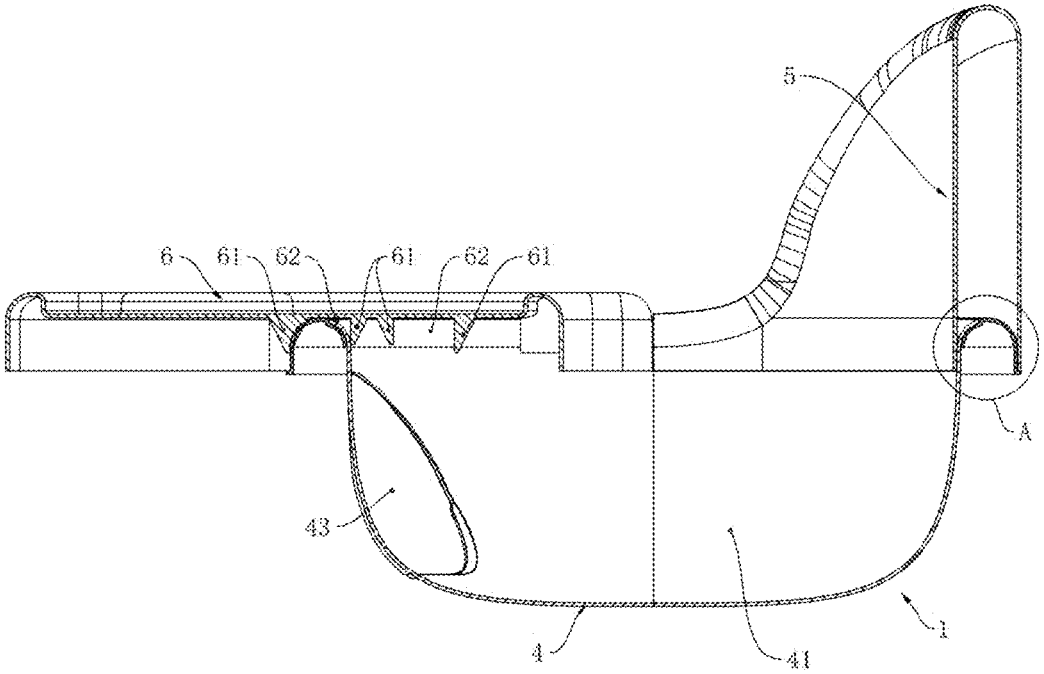
FIG. 6 is the section view of the high chair body in the invention.
Figure 7:
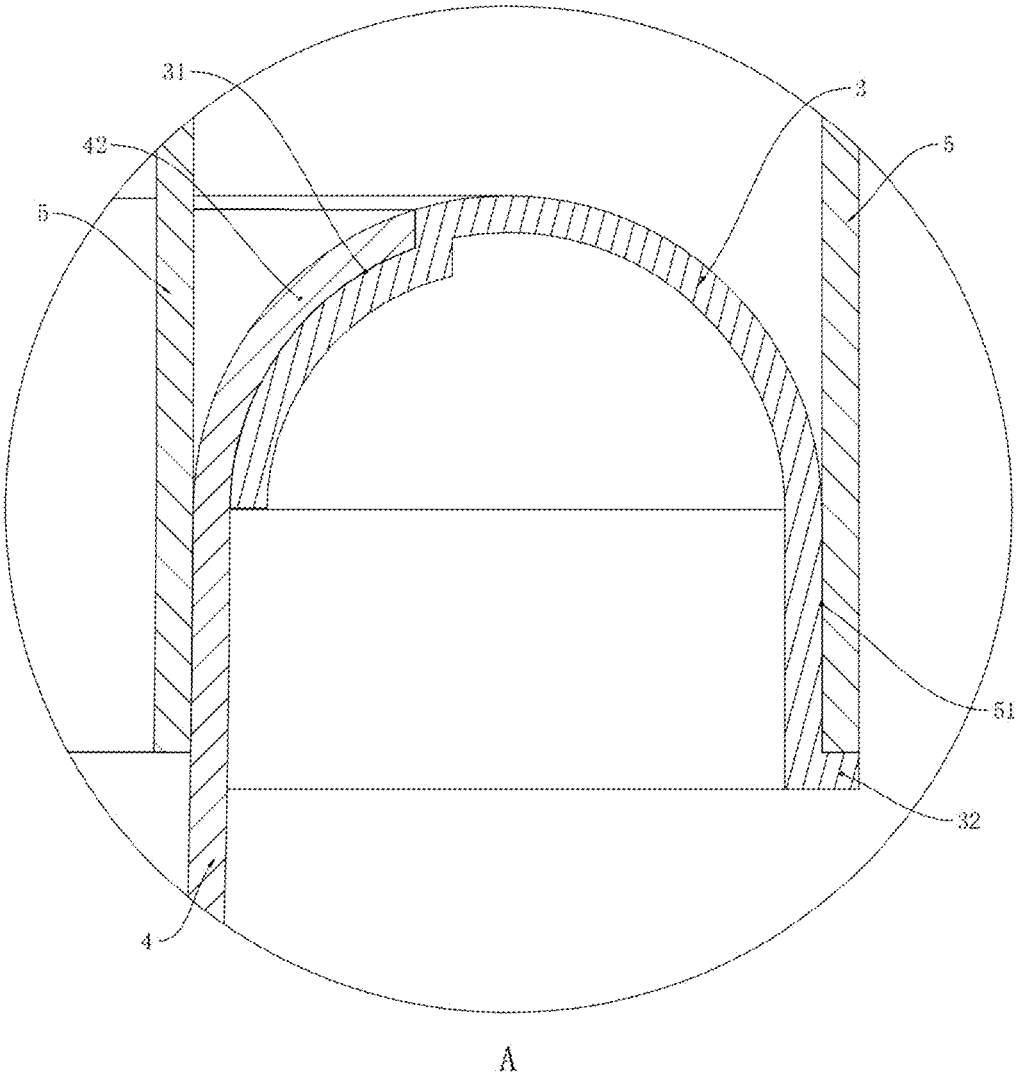
FIG. 7 is the enlarged view of point A in FIG. 6.

As shown in FIG. 4, FIG. 6 and FIG. 7, a through hole 34 is provided in the middle of the support ring 3, the upper half of the support ring 3 is recessed on the inner side to form a connecting part A 31, i.e., the connecting part A 31 is located on the upper half of the inner wall of the through hole 34 and/or the upper end face of the support ring 3, a connecting part B 42 is arranged on the upper edge 40 of the seat unit 4 and is connected to the connecting part A 31, and the upper end face of the connecting part B 42 is flush with the upper end face of the support ring 3, ensuring that the connection remains smooth and even after the support ring 3 and the seat unit are formed into a whole, and therefore improving comfort during use and facilitating cleaning.

As shown in FIG. 1 to FIG. 6, a mounting groove 51 with an opening facing downward is arranged at the lower end of the backrest 5, at least part of the shape of the backrest 5 matches the mounting groove 51, allowing the backrest 5 to be mounted onto the support ring 3 by inserting the upper end of the support ring 3 partially or fully into the mounting groove 51, thereby connecting the backrest 5 and the support ring 3. To ensure secure installation, the backrest 5 and the mounting groove 51 are connected by interference fit or embedded fit.

As shown in FIG. 7, an outwardly extending abutting parts 32 is arranged on the outer side of the support ring 3, and may be configured as a continuous annular protrusion, a protruding rib, or a plurality of protruding points arranged on the side wall of the support ring 3; when the end of the support ring is inserted into the mounting groove 51, the abutting part 32 butts against the opening edge of the mounting groove 51, i.e., the abutting part 32 butts against the lower end of the backrest 5, providing support for the lower end of the backrest, and ensuring post-installation stability.

In an embodiment, an anti-drop block is arranged on the backrest, and an anti-drop groove is arranged on the outer wall of the support ring 3. The anti-drop block is placed or separated from the anti-drop groove by external force to enhance the post-installation stability of the backrest 5.

As shown in FIG. 7, when the upper end of the support ring 3 is inserted into the mounting groove 51, both the connecting part A 31 and the connecting part B 42 are positioned within the mounting groove 51. The inner wall of the mounting groove 51 presses the connecting part B 42 against the connecting part A 31, thereby enhancing the connection stability between the connecting part A 31 and the connecting part B 42.

As shown in FIG. 1 to FIG. 6, a plate 6 is arranged on the support ring 3, a plurality of clamping strips 61 capable of elastic deformation are arranged in the middle of the lower end of the plate 6, a clamping groove A 62 is formed between the adjacent clamping strips 61, and clamping grooves B 63 are arranged at both sides of the lower end of the plate 6. By overcoming the elastic deformation force of the clamping strips 61, the end of the support ring 3 are inserted into the clamping groove A 62, while both sides of the support ring 3 are respectively arranged in the corresponding clamping grooves B 63, thereby achieving secure installation of the plate 6 onto the support ring 3.

The backrest 5 and the plate 6 are respectively installed on both sides of the upper end of the support ring 3, i.e., the backrest 5 is mounted on the rear half of the support ring 3, and the plate 6 is mounted on the front half of the support ring 3. The front end of the backrest 5 and the rear edge of the plate 6 fit or butt each other, ensuring a continuous smooth surface at the upper end of the high chair body 1 and avoiding dirt accumulation.

As shown in FIG. 2 to FIG. 5, the seat unit 4 is provided with two openings 43 on the side walls, and the openings 43 connect the seat portion 41 with the exterior, serving as passages for a child's legs to extend out from the seat portion 41.

As shown in FIG. 1 to FIG. 3, the chair leg 2 comprises a plurality of support feet 21, plug-in slots 33 corresponding to the support feet 21 are arranged at the lower end of the support ring 3, and the upper ends of the support feet 21 are plugged in the plug-in slots 33; a footrest 22 is connected between the two support feet 21 located beneath the front side of the support ring 3 to provide foot placement for the child, a crossbar 23 is connected between the two support feet 21 located beneath the rear side of the support ring 3, and both the footrest 22 and the crossbar 23 are designed to enhance the stability of the support feet 21.

Anti-slip pads are arranged at the lower ends of the support feet 21. The support feet 21 are formed by assembling a plurality of support rods through plug-in connections. Preferably, both ends of either the footrest 22 or the crossbar 23 are provided with connection holes or slots designed to insert the support rods.

The support ring 3, the backrest 5 and the plate 6 are made of rigid materials with deformation-resistant properties to prevent bending or structural distortion. The rigid material is specifically rigid plastic or metallic material, the metallic material may be stainless steel, and the rigid plastics is preferably polypropylene material. ABS, PET, or polycarbonate materials may alternatively be employed.

The above illustrates and describes the fundamental principles, key features and advantages of the present disclosure. Technicians in the field should understand that the present disclosure is not limited by the aforementioned embodiments, which are merely intended to explain the principles of the present disclosure as described in the specification. Without departing from the spirit and scope of the present disclosure, various modifications and improvements may be made, all of which fall within the claimed scope of the present disclosure. The scope of protection claimed by the present disclosure is defined by the appended claims and their equivalents.

The invention claimed is:

1. A high chair for children, comprising a high chair body and a number of chair legs installed at lower end of the high chair body, wherein the high chair body comprises:

a support ring;

a seat unit, which is made of flexible material, comprising a seat portion and an upper edge, the seat portion forming a accommodating cavity for a child to sit in, and the upper edge being connected to the support ring; the seat unit being deformable from the seat portion in the direction of the upper edge to enable folding of the seat unit;

wherein the support ring has an inner upper portion recessed to form a connection part A, and the upper edge of the seat unit has a connection part B, the connection part B is attached to the connection part A, and upper end surface of the connection part B is flush with upper end surface of the support ring.

2. The high chair for children according to claim 1, wherein the flexible material is flexible plastic or textile material.

3. The high chair for children according to claim 2, wherein the flexible plastic is one of PVC material, silicone and TPE material; the textile material is Oxford fabric or cotton fabric.

4. The high chair for children according to claim 1, wherein the support ring and the seat unit are connected by one of integrated injection molding, adhesive connection, detachable connection and hot press molding.

5. The high chair for children according to claim 1, wherein the high chair body also comprises a backrest, which is installed at one end of the support ring and is used for children to lean against; a mounting groove matching at least part of the shape of the support ring is arranged at lower end of the backrest, allowing the support ring to be partially inserted into the mounting groove.

6. The high chair for children according to claim 5, wherein an outwardly extending abutting part is arranged on outer side of the support ring; the abutting part abuts against the opening edge of the mounting groove.

7. The high chair for children according to claim 1, wherein a plate is provided on the support ring, a plurality of clamping strips are arranged in middle of lower end of the plate, a clamping groove A is formed between adjacent clamping strips, clamping grooves B are arranged on both sides of the lower end of the plate, end of the support ring is placed in the clamping groove A, and both sides of the support ring are respectively placed in corresponding clamping grooves B.

8. The high chair for children according to claim 1, wherein the chair legs comprise a plurality of support feet, plug-in slots corresponding to the support feet are arranged at lower end of the support ring, and upper ends of the support feet are connected with the plug-in slots; a footrest is connected between two support feet located at front side, and a crossbar is connected between the two support feet located at rear side.

* * * * *